US005842699A

United States Patent [19]

Mirando et al.

[11] Patent Number: 5,842,699

[45] Date of Patent: Dec. 1, 1998

[54] BASKETBALL GAME APPARATUS

[75] Inventors: Salvatore Vincent Mirando, Holmdel; Leonard Dean, Jr., Middletown; Dennis Lawrence, Cream Ridge; Keith Eaton, Long Branch, all of N.J.; Michael Cheek, Lansing, Ill.; J. Richard Oltman, Scottsdale, Ariz.; Daniel Bennet, Monmouth, N.J.

[73] Assignee: Coastal Amusements, Inc., Lakewood, N.J.

[21] Appl. No.: 711,891

[22] Filed: Sep. 12, 1996

[51] Int. Cl.[6] ..... A63B 63/08

[52] U.S. Cl. ..... 273/317.3; 273/397; 473/448; 473/480

[58] Field of Search ..... 273/1.5 R, 317.3, 273/402, 397, 354, 369, 368; D21/201, 5; 473/433, 447, 448, 472, 479, 485, 480

[56] References Cited

U.S. PATENT DOCUMENTS

| | | | |
|---|---|---|---|
| D. 216,684 | 3/1970 | Haubert | D21/201 X |
| D. 239,044 | 3/1976 | Jackson | D21/5 |
| D. 315,938 | 4/1991 | Doyle | D21/201 |
| 2,504,818 | 4/1950 | Findon | 273/402 |
| 2,734,745 | 2/1956 | Tarte, Jr. . | |
| 2,747,875 | 5/1956 | Martin | 273/397 |
| 3,362,712 | 1/1968 | Wagner . | |
| 3,477,714 | 11/1969 | Garlington | 273/369 X |
| 3,565,427 | 2/1971 | Michael | 273/1.5 R |
| 3,703,289 | 11/1972 | Hohman | 273/368 X |
| 3,794,318 | 2/1974 | Holmes | 273/354 X |
| 4,079,937 | 3/1978 | Kirsch | 273/317.3 |
| 4,266,764 | 5/1981 | Collins | 273/354 X |
| 4,747,597 | 5/1988 | Kluczny . | |
| 4,805,917 | 2/1989 | Cochran et al. | 273/397 |
| 4,936,577 | 6/1990 | Kington et al. . | |
| 5,035,423 | 7/1991 | Arciniega . | |
| 5,074,552 | 12/1991 | Gomez et al. . | |
| 5,096,191 | 3/1992 | Fang . | |
| 5,125,651 | 6/1992 | Keeling et al. . | |
| 5,330,175 | 7/1994 | Kim . | |
| 5,458,325 | 10/1995 | Klein et al. | 273/1.5 R |

FOREIGN PATENT DOCUMENTS

| | | | |
|---|---|---|---|
| 618199 | 2/1961 | Italy | 273/1.5 R |
| 634867 | 2/1962 | Italy | 273/354 |

OTHER PUBLICATIONS

Brochure, "Hoop it Up" Atari Games, 1995.

RePlay Magazine, Mar.–1988, p. 116, Sports–Themed Games (D21/201) Mar. 1988.

*Primary Examiner*—Jessica Harrison
*Attorney, Agent, or Firm*—William Squire

[57] ABSTRACT

A collapsible playing section is removably attached to a player console and include casters as a stand alone amusement unit. A background includes three vertically aligned hoops, the medially one being rotated in a plane periodically out of alignment with the other two hoops which are stationary. One or more players in a coin operated game toss five balls in an attempt to pass the ball through all three hoops. A spring loaded telescoping link assembly for operating the moving hoop prevents ball jams. Points and prizes are assigned and awarded based on the number of hoops rung by a given player. More or fewer hoops, their speed of motion and the relative position of the movable hoop of hoops differ in different embodiments.

23 Claims, 3 Drawing Sheets

BASKETBALL GAME APPARATUS

This invention relates to a basketball game, and more particularly, to a basketball amusement apparatus involving a movable hoop.

Basketball amusement apparatus and devices involving movable hoops are known. U.S. Pat. No. 5,074,552 discloses one such device. A hoop is mounted to a backboard which is rotatable about a vertical axis. A thrower is provided a variety of angles from which to throw the basketball in an effort to ring the hoop with the ball.

U.S. Pat. No. 5,330,175 discloses an automated game assembly for use by at least one player having a basketball hoop mounted to a backboard. The hoop and backboard are rotated about a vertical axis. Also, the hoop and backboard are linearly displaced toward and away from the player.

U.S. Pat. No. 5,035,423 discloses a rotating basketball goal for basketball training for shooting a ball at various angles and distances. U.S. Pat. No. 2,734,745 discloses a revolving ball target wherein the target is basket-ball like except the target opening is in a vertical plane and the target rotates about a vertical axis. A ball needs to be tossed through the target opening in a horizontal direction.

U.S. Pat. Nos. 5,096,191 and 5,125,651 disclose basketball training systems wherein in '191 the so-called hoops are semicircular and nested one within the other forming a target hoop, an auxiliary hoop and a collection hoop. In '651, two hoops are offset vertically from one another in fixed position for providing ball path trajectory training.

The present inventors recognize a need for a basketball amusement game involving additional skill over the games of the prior art including those described above.

A basketball game apparatus according to the present invention comprises a plurality of basketball hoops secured in vertical alignment one over the other such that a basketball falling through the topmost one of the hoops falls through each lower hoop of the plurality of hoops and means for periodically displacing at least one of the hoops in and out of the vertical alignment to preclude the basketball falling through each lower hoop from the topmost one of the hoops unless the hoops are aligned.

In one aspect of the present invention, the periodically displacing rotationally displaces the at least one hoop.

In a further aspect, the periodically displacing displaces the one hoop in translation.

In a further embodiment, three hoops are included, the at least one hoop being located intermediate the other hoops.

In a still further embodiment, the hoops each define parallel planes, the at least one hoop being rotated in its plane about a vertical axis.

IN THE DRAWING

Figure 1:
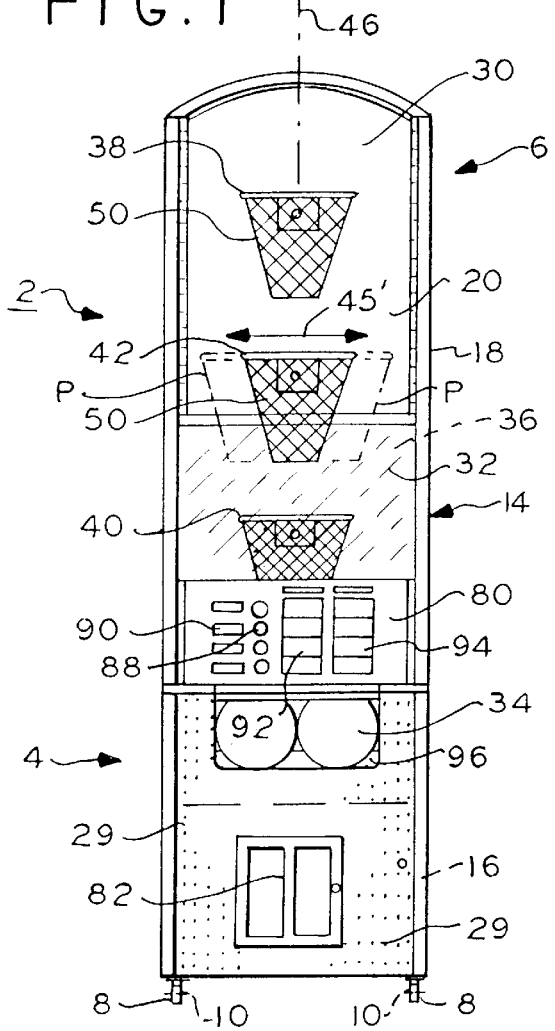
FIG. 1 is a front elevation view of a basketball game amusement apparatus according to an embodiment of the present invention.
Figure 2:
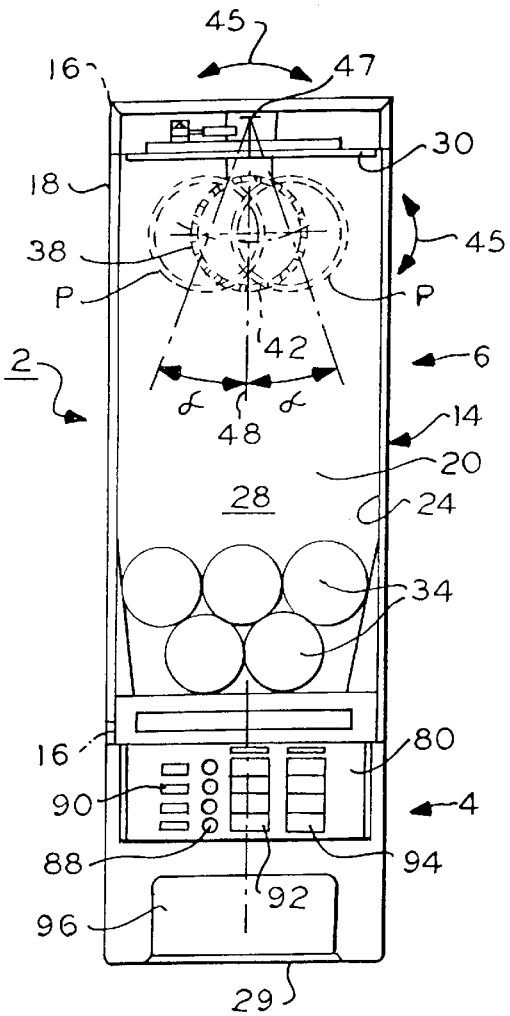
FIG. 2 is a plan top view of the apparatus of FIG. 1 with the outer netting (FIG.3) removed.
Figure 3:
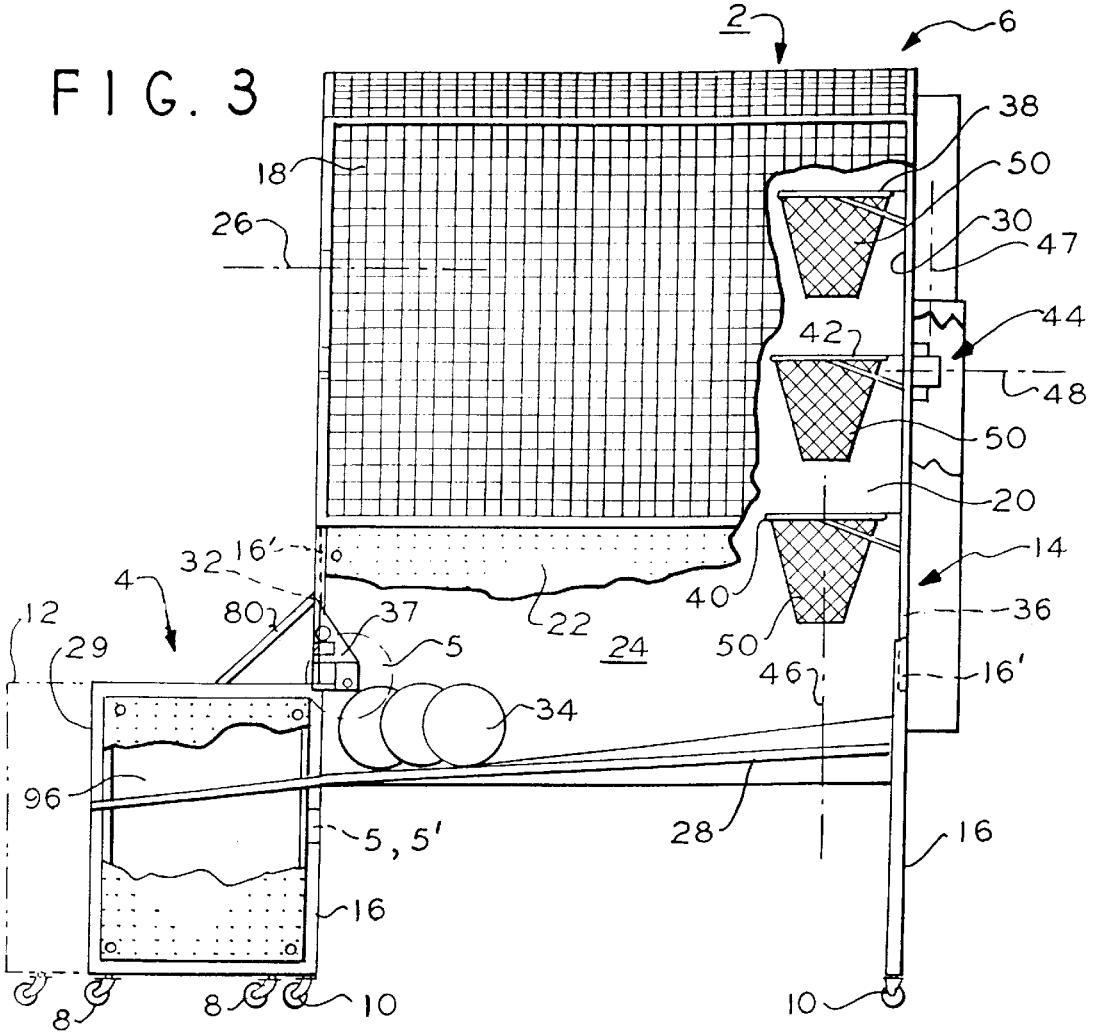
FIG. 3 is a partially in section side elevation view of the apparatus of FIG. 1

In FIGS. 1, 2 and 3, coin electrically operated basketball amusement apparatus 2 includes a player console 4 and a game section 6 which are detachably secured by connectors to form a composite unit shown in the FIGS. The console 4 has casters 8 and the section 6 has its corresponding casters 10. The console 4 may be displaced from the game section as shown in phantom in FIG. 3 at 12.

In the preferred embodiment illustrated, the apparatus 2 is a stand alone unit which is movable to a playing site for operation by one or more players. The console 4 and section 6 are separable and may be transported as separate units.

In the alternative, the apparatus 2 may be installed fixed in place without separate movable console and game sections, and may be constructed as multiple side-by-side amusement apparatuses with a fixed counter (not shown) for housing the separate console controls and operating elements for each side-by-side game to be described below herein.

The game playing section 6, FIG. 3, comprises a frame 14 attached to casters 10 via legs 16. A wire netting 18 is attached to the frame 14 and surrounds the upper playing region 20. Lower side walls 22 are secured to frame 14 on opposite sides of section 6 to enclose the lower playing region 24. The frame 14, fabricated sheet steel, includes structure comprising telescoping legs 16 and mating legs 16 ' on frame 14 so as to be collapsible to permit the region 20 to be collapsed to the broken line 26.

Figure 5:
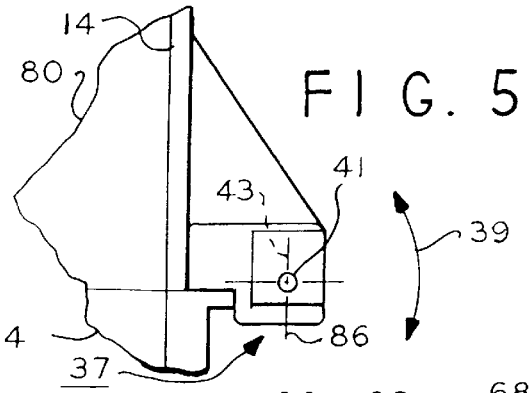
FIG. 5 is a more detailed view of the apparatus of FIG. 3 taken at region 5.

Attached to the frame 14 is a lower inclined ball return platform 28. A rear wall 36 is connected to the frame 14 forming part of the backboard and extends for the full height of the player regions 20 and 24 above platform 28. A backboard 30, comprising a plastic sheet overlay with artwork screened thereon, is secured to and in front of rear wall 36. A front transparent, preferably thermoplastic, wall 32, FIGS. 1 and 3, is secured to the frame 14 in the front of the playing regions 20 and 24. The platform 28 is ramped to guide balls 34 to the front storage area of region 24 from the playing regions 20 and 24. An electrically operated gate assembly 37, to be described in connection with FIG. 5, is attached to frame 14 at the front of and spaced above platform 28. The gate assembly 37 selectively retains the balls 34, preferably five balls of like diameter, e.g., seven inches, on the platform 28, out of reach of a player at the front 29 of the console 4.

In FIG. 5, gate assembly 37 comprises a gate 86 which is rotatable in directions 39 via shaft 41. A gate drive motor 43 rotates the gate 86 and shaft 41. The gate 86 is rotatable about 90° to the position shown in dashed line counterclockwise in the figure toward the held balls 34. The position of the gate 86 is determined by a position sensor (not shown). The gate 86 preferably is a metal blade that extends across the path of the balls on platform 28. The drive motor 43 operates in response to activation of a player operated push button to be described. The gate 86 is held in the ball release position (dashed line) for a desired momentary interval and then returned to its home ball retaining position (solid line).

A topmost circular hoop 38, made of metal or any suitable material, preferably approximately 13 inches in internal diameter, is secured fixed to the backboard 30, preferably about seven feet from the console 4 front 29. The hoop 38 is approximately eight feet above the casters 10. A lowermost hoop 40 is of the same construction as hoop 38 and spaced vertically below and aligned with hoop 38. The hoop 38 may be about 38 inches above the hoop 40 in this embodiment. The hoop 40 is fixed to the backboard wall 36. A movable hoop 42 is attached to frame 14 via drive mechanism 44. The hoop 42 is medially the hoops 38 and 40 and preferably is of the same diametrical dimensions as the hoops 38 and 40. The hoop 42 has a central position that is vertically aligned with the hoops 38 and 40 on vertical axis 46. The planes of all of the hoops 38, 40 and 42 are parallel and normal to axis 46. When in the aligned central position on axis 46, FIGS. 1 and 3, the hoop 42 permits a ball 34 passing through the topmost hoop 38 to drop therethrough into and through the lowermost basket 40.

However, the movable hoop 42 is mounted to rotate in a plane defined by horizontal axis 48±angle α, FIG. 2. The hoop 42 rotates from horizontal axis 48 and from the central position vertical axis 46, preferably about 20°, by mechanism 44, directions 45. The hoop 42 preferably rotates about 14 cycles a minute. A cycle is a full horizontal oscillation from and to axis 48. The cyclical rate may differ from this value, may be constant or may be variable in a given cycle or from cycle to cycle according to a given implementation. That is, the rotational speed from extreme positions P of the hoop 42, FIGS. 1 and 2, shown in phantom, may be constant or may vary in a cycle or from cycle to cycle, as desired in a given implementation.

When the hoop 42 shifts from the position of vertical alignment with vertical axis 46, a ball 34 passing through the topmost hoop 38 may or may not pass through the medial hoop 42 and thus lowermost hoop 40 depending upon the hoop 42 position from axis 46. A ball passing through the medial hoop 42 might also miss the lowermost hoop 40. This might be due to the timing of the ball in the hoop 42 and the position of the hoop 42 relative to the lowermost hoop 40. Each completion of a hoop by a ball may be assigned point values in the game and given tickets or other rewards depending upon the number of hoops of the three hoops 38, 42 and 40 passed through by a given ball.

In the present game, a player is given five balls which amount may differ according to a given implementation. A player preferably should toss a ball into the topmost hoop 38 first to maximize his score. If a player gets a ball into a lower hoop first, e.g., hoop 40 or 42, values may be assigned this as well. For example, a bonus might be assigned for completion of all three hoops, and score values assigned each of the individual hoops completed if less than all three hoops are completed.

Preferably attached to each hoop 38, 40 and 42 is an identical pliable and stretchable basket net 50. The nets 50 are made of any suitable material for this purpose. A net 50 has the same diameter as the corresponding hoop at its topmost region and tapers to a narrower conduit at its lowermost end. Preferably, each net 50 has a lowermost opening of about six inches, and preferably smaller than the ball diameter, and a vertical height of about twelve inches in this embodiment, which values may differ according to a given implementation. The nets are spaced above the next lower hoop by a distance preferably about six inches by way of illustration. All of these values are determined according to a given implementation and may differ from implementation to implementation.

The ball 34 is slightly larger than the net 50 bottom opening diameter. This serves to slow the ball passing therethrough according to the pliability and friction of the net 50 and, therefore, increases the difficulty of the game.

Figure 4:
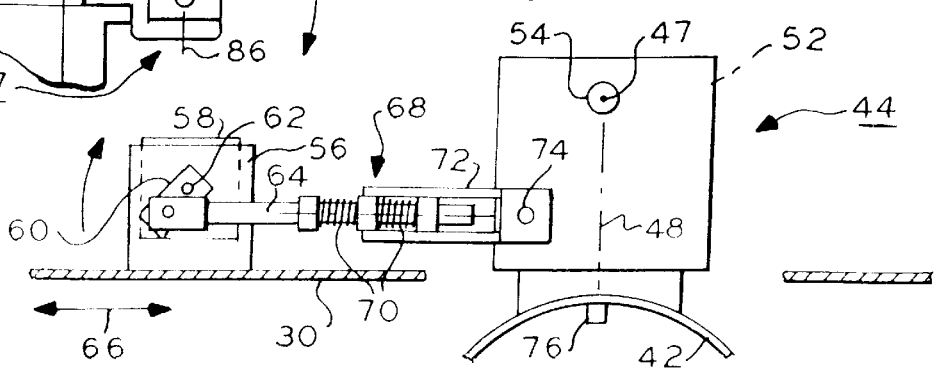
FIG. 4 is a more detailed plan view of a basketball hoop drive mechanism employed in the apparatus FIGS. 1–3.

In FIG. 4, drive mechanism 44 for rotating the hoop 42 comprises a hoop support bracket 52. A hoop pivot shaft 54 rotatably supports the bracket 52 for rotation about axis 47, directions 45. A shaft 54 support bracket (not shown) is fixed to the frame 14 and backboard 30. The shaft 54 defines vertical axis of rotation 47 and horizontal axis 48.

A bracket 56 is fixed to the frame 14 and backboard 30. A motor 58 is secured to bracket 56. A speed reduction gear box (not shown) may be coupled to the motor 58 A rotatably driven crank 60 is connected to the motor 58 drive shaft 62 and driven thereby. A link 64 of telescoping links 68 is pinned to the crank 60 and reciprocated generally in directions 66 by the rotating crank 60. Link 64 telescopes relative to and within link 72 of links 68 for reciprocating link 72 in directions 66. The links 64 and 72 are resiliently movably intercoupled by springs 70. Link 72 is pivoted to bracket 52 by pin 74.

A ball 34 sensor switch 76 is secured to each hoop for sensing when a ball 34 passes through that hoop. The switch 76 closes a circuit to a counter (not shown) in the circuit of FIG. 6 to be described for assigning and tallying a player's score for each successful pass of a ball through a hoop.

In operation of the mechanism 44, motor 58 rotates crank 60 and reciprocates links 68 in directions 66. This pivots the bracket 52 and corresponding hoop 42 about axis 47 in the plane of axis 48 and the hoop 42. In this case, the cycles are of uniform duration, but the rate of rotation of the hoop 42 varies in a cycle. The telescoping links 68 serve an important function.

In FIG. 2, for example, should a ball in play become lodged between hoop 42 at an extreme positon P (in phantom) and the side wall netting 18, the links 68 will not jam. Should a ball 34 be so lodged, the spring loaded telescoping links 68 merely telescope into a collapsed state (not shown) as the crank 60 rotates. Eventually, the hoop 42 will be rotated to a position where the lodged ball will be free and drop out of the lodged state. The telescoped links 68 will resiliently return to their normal extended state when the ball 34 dislodges.

Figure 6:
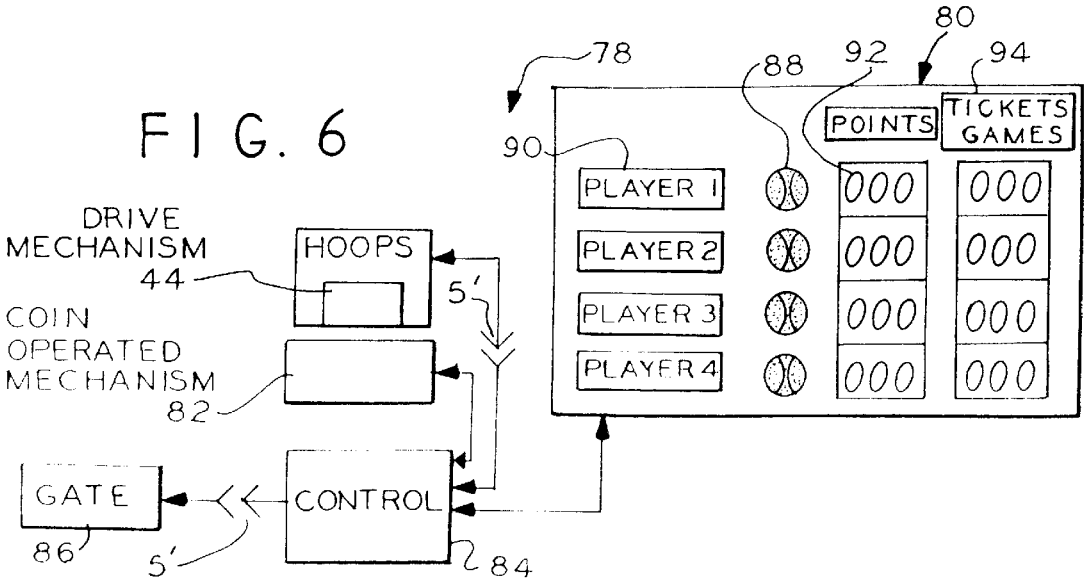
FIG. 6 is a circuit and display diagram for operating the apparatus of FIG. 1.

In FIG. 6, control circuit 78 includes a player control panel 80 operated by a coin operated mechanism 82 and control 84, ball gate 86 in gate assembly 37 operated by the control 84 and the drive mechanism 44 controlled by the control 84. It should be understood that the single lines in FIG. 6 represent multiple wires or busses as the case may be. The coin operated mechanism 82, a portion of the control 84 for operating the panel 80 and the panel 80 are commercially available. The sensor switches 76 at each hoop are also coupled to the control 84.

The control panel 80 comprises four push buttons 88 which are illuminated by lamps (not shown) in response to insertion of a coin for each player. The buttons 88 each illuminate as a coin is inserted. A button 88 will flash for player 1 until pressed by player 1 indicating player 1 is activate. The lamp for player 1 at button 88 is then turned off. The player designation display 90 for player 1 will flash for a predetermined time, e.g., about 25 seconds. During this time all other buttons 88 are disabled. After the time interval, which is adjustable by means not shown, preferably about 24 seconds, expires for player 1, the player 1 display 90 illuminates continuously indicating that another player, e.g., player 2, can press the player 2 corresponding button 88 and start to play. At this time the play for player 1 terminates and player 1 can no longer score by completion of a ball through a hoop.

The next player is then given the time interval, e.g., 24 seconds to shoot all five balls. Only one player designation display 90 is illuminated at a time indicating which player is active and playing the game. A lamp (not shown) under control of control 84 is located at each button 88 and display 90.

Pushing a button 88 causes control 84 to operate a gate 86 opening drive (not shown), opening the gate 86 and releases all five balls to the player. The gate 86 remains open for a predetermined time to allow all balls to be released and then automatically closes. The balls 34 roll down the platform 28 into chute 96 to the player at the front 29 of the console 4.

A this time a further timer in control 84 commences a "shot" clock, i.e., times the amount of time the player has to shoot the five balls, e.g., the 24 second interval noted above. Points are accumulated in the points display 92 as each hoop sensor 76 (FIG. 4) senses a ball passing through that hoop. A bonus may be scored for all three hoops being completed by one ball. The points are tallied in the points display 92. As points are accumulated, tickets or games won may be assigned that player at the display 94. The next player commences his play by pushing his button which opens the gate 86 releasing the five balls to him, the display 90 for him illuminates as described above and so on until all players complete their play. The coin operated mechanism 82 and portions of the control 84 and the display panel 80 are conventional for general use in commercially available amusement games. Many such games operate in similar fashion from a control point of view in which balls are released to a player, points tallied based on player achievement with the balls, gates opened and closed and so on.

What is novel in the present application is the use of the hoops and their arrangement as disclosed herein. The hoop 42 may be always oscillating in an on state (by a switch not shown) whether or not a game is in play by a player. In the alternative, the hoop 42 may commence oscillation when play begins by a player.

In FIGS. 1–3, the console 4 comprises a cart on casters 8 on which the panel 80 is mounted. Electrical connectors (not shown) interconnect the electrical circuit of FIG. 6 in the console 4 to the appropriate wiring in the game section 6. The console 4 inclined chute 96 receives the balls 34 from platform 28 after passed by gate assembly 37. Coin mechanism 82 is located at the console 4 front.

Figure 7:
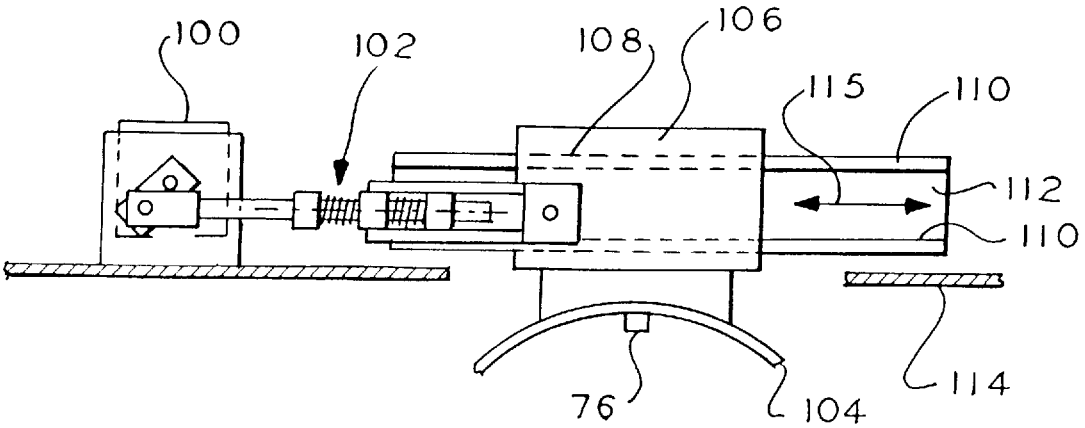
FIGS. 7 and 8 are further embodiments of a hoop drive mechanism.

In an alternative embodiment, FIG. 7, motor 100 reciprocates links 102 as in the embodiment of FIG. 4. Hoop 104 is secured fixed to support 106. Support 106 has guides 108 which mate with guide rails 110 on bracket 112 secured to the frame and backboard assembly 114. The links 102 reciprocate the support 106 in directions 115. The translation speed of the support 106 is determined according to a given implementation as discussed above.

Figure 8:
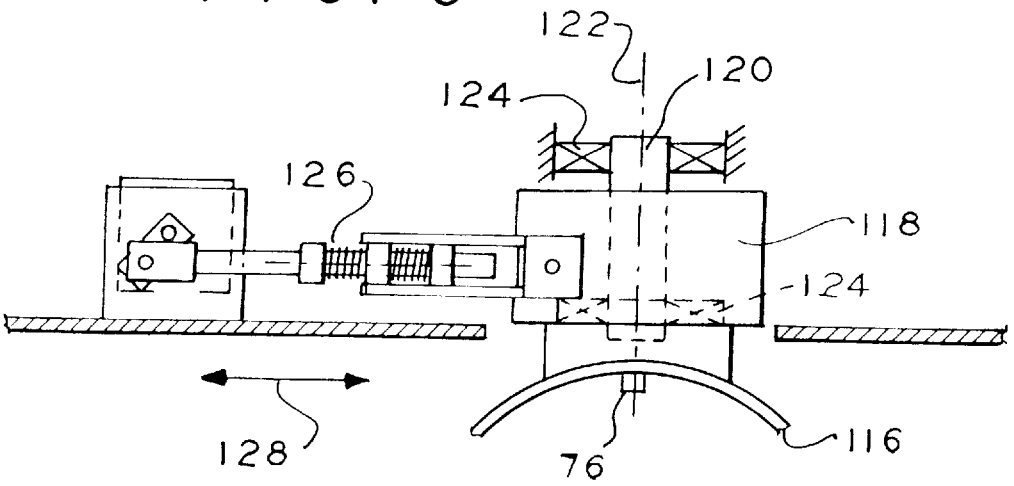

In FIG. 8, hoop 116 is fixed to support 118. Support 118 is mounted on a pivot shaft 120. Shaft 120 rotates about horizontal axis 122 via bearings 124. Reciprocation of links 126 in directions 128 rotates the support 118 about axis 122 rotating the hoop 116 similarly. Only when the hoop 122 is substantially aligned parallel to the other remaining hoops, will a ball fall through all hoops. Of course this depends upon the timing of the ball falling through the various nets and so on as discussed above.

While three hoops are preferred with the central hoop in motion, other embodiments may include two hoops one of which is in motion or more than three hoops. Also the uppermost or lowermost hoops may be in motion in the alternative to the central medial hoop or in addition thereto. For example, the topmost hoop may be the only hoop in motion or the lowermost hoop may be the only hoop in motion.

It will occur to one of ordinary skill that various modifications may be made to the disclosed embodiments without departing from the scope of the invention as claimed herein. It is intended that the scope of the invention is according to the appended claims. The disclosed embodiments are given by way of example and not limitation.

What is claimed is:

1. A basketball game apparatus comprising:

A plurality of basketball hoops secured in vertical alignment on a first vertical axis one over the other such that a basketball falling through the topmost one of said hoops falls through each lower hoop of said plurality of hoops, at least one of said plurality of hoops being fixedly secured on said vertical axis; and means for periodically displacing at least one further one of said plurality of hoops different than said at least one fixedly secured hoops in and out of said vertical alignment to preclude said basketball falling through a lower hoop from an upper one of said hoops unless the upper and lower hoops are aligned.

2. The apparatus of claim 1 wherein said means for periodically displacing includes means for rotationally displacing the at least one further one of said plurality of hoops.

3. The apparatus of claim 2 wherein the hoops each define parallel planes, the apparatus including means for rotating at least one further one of said plurality of hoops in its plane about a second vertical axis.

4. The apparatus of claim 1 including three said hoops, the at least one further one of said plurality of hoops being located intermediate the remaining ones of the hoops, said remaining ones of the hoops being fixedly secured on said vertical axis.

5. The apparatus of claim 1 further including a net secured to and depending from each said hoops, said net forming a ball conduit, said conduit having a ball receiving opening at the corresponding hoop at least as large as said basketball and an outlet distal and beneath said corresponding hoop of diameter smaller than said basketball and being sufficiently pliable to permit the ball to fall therethrough by the force of gravity.

6. The apparatus of claim 1 including a movable cart, means for forming said hoops and means for periodically displacing into a movable collapsible playing section and means for releasably electrically and mechanically coupling said playing section to said cart to provide a stand alone movable game apparatus.

7. The apparatus of claim 6 wherein said cart and playing section each including a portion of a ball return platform, said playing section including a ball return gate, said cart including means for electrically activating said gate.

8. The apparatus of claim 1 wherein the plurality of basketball hoops and means for displacing form a playing section, further including a console section and means for releasably securing the console section to the playing section, said console section and playing section each including a portion of a ball storing and return platform, and gate means in said playing section for selectively returning balls on said platform from the playing section to said console section.

9. The apparatus of claim 1 including means for electrically activating at least said means for periodically displacing and further including a movable cart console including said means for electrically activating and a game playing section including said plurality of hoops, a ball return platform forming a playing region with said plurality of hoops and ball containing means about said region, and means for mechanically and electrically releasably coupling said game playing section to said cart console to provide a stand alone movable game apparatus.

10. The apparatus of claim 9 wherein said cart includes a portion of said ball return platform.

11. The apparatus of claim 9 including collapsible means for permitting said plurality of hoops and said ball containment means to form a collapsed mobile playing section.

12. The apparatus of claim 1 including electrically operated means operatively coupled to said hoops for electrically operating said means for displacing and for recording a score manifesting the number of said plurality of hoops entered by at least one basketball and further including 1) console means for selectively electrically activating electrically operated game playing means and scoring means, 2) playing section means including said plurality of hoops and means for periodically displacing, and 3) means for electrically and mechanically releasably coupling the console means to said playing section means.

13. The apparatus of claim 12 including means for providing a first score upon entering of a portion of said plurality of hoops by said at least one basketball and a bonus score when all of said plurality of hoops are entered by said at least one basketball.

14. The apparatus of claim 1 including means for setting the displacement speed of said at least one hoop to a uniform predetermined rate in each period.

15. The apparatus of claim 14 including means for setting the displacement speed to a selected one of a plurality of rates.

16. The apparatus of claim 1 wherein said means for displacing said at least one hoop includes means for varying said displacement speed during each period.

17. A basketball game apparatus comprising:

a mobile player console for electrically activating said game apparatus; and a mobile game playing section electrically and mechanically releasably coupled to said console for selective coupling to and operation with said console, said playing section comprising:

a plurality of basketball hoops secured in vertical alignment on a vertical axis one over the other such that a basketball falling through the topmost of said hoops falls through each lower hoop of said plurality of hoops, at least one of said hoops being fixedly secured on said axis; and means for periodically displacing at least one of said hoops in and out of said vertical alignment to preclude said basketball falling through a lower one of said hoops from an upper one of said hoops unless the hoops are aligned.

18. The apparatus of claim 17 including three hoops each lying in a plane wherein the means for displacing includes means for oscillating the at least one hoop about an axis normal to the plane of the hoops.

19. The apparatus of claim 18 wherein the at least one hoop is central said three hoops.

20. The apparatus of claim 17 wherein said mobile player console includes coin operated control means for causing said playing section to provide at least one basketball to the console and for recording a player score.

21. A basketball game apparatus comprising:

a mobile player console for electrically activating said game apparatus; and a mobile game playing section electrically and mechanically releasably coupled to said console for selective coupling to and operation with said console, said playing section comprising at least one basketball hoop.

22. The apparatus of claim 21 wherein the console and playing section include complementary ball receiving platforms and electrically activated means for selectively feeding a basketball to a player at said console from said playing section.

23. The apparatus of claim 21 wherein the at least one hoop comprises a plurality of hoops secured in vertical alignment one over the other on an axis such that a basketball falling through the topmost of said hoops falls through each lower hoop of said plurality of hoops, at least one of said plurality of hoops being fixedly secured on said axis and means for periodically displacing at least one of said plurality of hoops in and out of said vertical alignment on said axis to preclude said basketball falling through a lower one of said hoops from an upper one of said hoops unless the hoops are aligned on the axis.

* * * * *